US009506018B2

(12) United States Patent
D'Ambrogio et al.

(10) Patent No.: US 9,506,018 B2
(45) Date of Patent: Nov. 29, 2016

(54) MICROFIBROUS CELLULOSE AND ALKALINE EARTH METAL ION STRUCTURED SURFACTANT COMPOSITION

(75) Inventors: Robert D'Ambrogio, Princeton, NJ (US); Joan Ethel Gambogi, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 760 days.

(21) Appl. No.: 13/505,669

(22) PCT Filed: Nov. 4, 2010

(86) PCT No.: PCT/US2010/055427

§ 371 (c)(1), (2), (4) Date: May 2, 2012

(87) PCT Pub. No.: WO2011/056956

PCT Pub. Date: May 12, 2011

(65) Prior Publication Data

US 2012/0225804 A1 Sep. 6, 2012

Related U.S. Application Data

(60) Provisional application No. 61/257,940, filed on Nov. 4, 2009.

(51) Int. Cl.

| | |
|---|---|
| ***C11D 1/00*** | (2006.01) |
| ***C11D 3/04*** | (2006.01) |
| ***C11D 3/22*** | (2006.01) |
| ***C11D 17/00*** | (2006.01) |

(52) U.S. Cl.

CPC ..... *C11D 3/222* (2013.01); *C11D 1/002* (2013.01); *C11D 3/046* (2013.01); *C11D 3/048* (2013.01); *C11D 3/22* (2013.01); *C11D 3/225* (2013.01); *C11D 17/0013* (2013.01)

(58) Field of Classification Search

CPC ..... C11D 1/002; C11D 3/046; C11D 3/048; C11D 3/22; C11D 3/222; C11D 3/225

USPC ..... 510/470, 471, 473

See application file for complete search history.

(56) References Cited

U.S. PATENT DOCUMENTS

| | | | | |
|---|---|---|---|---|
| 5,653,970 | A * | 8/1997 | Vermeer | 424/70.24 |
| 7,101,612 | B2 * | 9/2006 | Lang et al. | 528/288 |
| 2003/0109391 | A1 | 6/2003 | Midha et al. | |
| 2006/0019860 | A1 | 1/2006 | Cardozo et al. | |
| 2007/0010415 | A1 | 1/2007 | Kinscherf et al. | |
| 2007/0066507 | A1 | 3/2007 | Fleckenstein et al. | |
| 2008/0070823 | A1 | 3/2008 | Gorlin et al. | |
| 2008/0108541 | A1 * | 5/2008 | Swazey | 510/535 |
| 2008/0108714 | A1 | 5/2008 | Swazey et al. | |
| 2008/0146485 | A1 * | 6/2008 | Swazey | 510/446 |
| 2008/0242581 | A1 | 10/2008 | Murphy et al. | |
| 2009/0105113 | A1 * | 4/2009 | Tuzi et al. | 510/418 |
| 2009/0186796 | A1 | 7/2009 | Gomez Ruiz et al. | |
| 2009/0227482 | A1 * | 9/2009 | Dong et al. | 510/125 |
| 2010/0009891 | A1 * | 1/2010 | Canto et al. | 510/418 |
| 2011/0079693 | A1 * | 4/2011 | Burkman | 248/224.8 |

FOREIGN PATENT DOCUMENTS

| | | |
|---|---|---|
| WO | WO 2008/076753 | 6/2008 |
| WO | WO 2008/079693 | 7/2008 |
| WO | WO 2009/101545 | 8/2009 |

OTHER PUBLICATIONS

Lehigh River Watershed Explorations, "Calcium and Water Hardness", 2000.*

ISR & Written Opinion for PCT/US10/055427 mailed on Feb. 11, 2011.

* cited by examiner

*Primary Examiner* — Gregory R Delcotto

(57) ABSTRACT

An aqueous composition comprising at least one surfactant; a suspending agent comprising micro fibrous cellulose; 10 to 600 ppm of an alkaline earth metal ion, and water. The composition can be used to structure surfactant systems to suspend material in the composition.

7 Claims, No Drawings

MICROFIBROUS CELLULOSE AND ALKALINE EARTH METAL ION STRUCTURED SURFACTANT COMPOSITION

CROSS REFERENCE TO RELATED APPLICATIONS

This application is a national stage entry under 35 U.S.C. 371 of International Patent Application No. PCT/US10/55427, filed on 4 Nov. 2010, which claims priority to U.S. Provisional Patent Application No. 61/257,940, filed on 4 Nov. 2009, the contents of each are incorporated herein by reference.

BACKGROUND OF THE INVENTION

Structured liquids are known in the art for suspending materials such as beads in liquid cleaning compositions. The methods of providing structure to the liquid includes using particular surfactants to structure the liquid, or by the addition of suspending agents such as polymers, natural gums and clays that enable the liquid to suspend materials therein for long periods of time. These suspended materials can be functional, non-functional (aesthetic), or both. By aesthetic it is meant that the suspended materials impart a certain visual appearance that is pleasing or eye catching. By functional it is meant that the suspended materials contribute to the action of the composition in cleaning, fragrance release, shine enhancement, or other intended action of the composition.

To keep the suspended materials suspended in the liquid without sinking or floating requires the yield stress of the composition to be sufficient. It would be desirable to increase the yield stress to keep suspended materials suspended.

BRIEF SUMMARY OF THE INVENTION

An aqueous composition comprising a) at least one surfactant;

b) a suspending agent comprising microfibrous cellulose;

c) 10 to 600 ppm of an alkaline earth metal ion; and d) water.

DETAILED DESCRIPTION OF THE INVENTION

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The composition comprises at least one surfactant and microfibrous cellulose in which the yield stress of the composition is increased by the addition of an alkaline earth metal ion.

In one embodiment, the microfibrous cellulose is present in the composition in an amount of 0.01 to 0.12 weight %. In other embodiments, the amount is at least 0.02, 0.03, 0.04, 0.05, 0.06, 0.07, 0.08, 0.09, 0.1 up to 0.12 weight %. In one embodiment, the amount is 0.048 weight %.

In one embodiment, the microfibrous cellulose is a combination of microfibrous cellulose (MFC), xanthan gum, and carboxymethylcellulose (CMC), which is available from CP Kelco as Cellulon™ PX or Axcel™ CG-PX. It is a 6:3:1 blend by weight of MFC:xanthan gum:CMC. It is further described in United States Patent Publication Nos. 2008/0108714A1, 2008/0146485A1, and 2008/0108541A1. On addition of water, the xanthan gum and CMC become hydrated and provide for better dispersion of MFC. CP Kelco reports that salts will impair sufficient hydration of the xanthan gum and CMC co-agents resulting in poor activation of MFC.

In one embodiment, the MFC:xanthan gum:CMC is present in the composition in an amount of 0.01 to 0.2 weight %. In other embodiments, the amount is at least 0.02, 0.03, 0.04, 0.05, 0.06, 0.07, 0.08, 0.09, 0.1, or 0.15 up to 0.2 weight %. In one embodiment, the amount is 0.08 weight %.

The structuring capability of MFC can be increased by including an alkaline earth metal ion (such as calcium or magnesium) in the composition. In certain embodiments, the amount of the alkaline earth metal ion is 10 to 600 ppm. In another embodiment, the amount of alkaline earth metal ion is 75 to 300 ppm. In other embodiments, the amount of ion is at least 75, 80, 90, 100, 110, 120, 130, 140, 150, 160, 170, 180, 190, 200, or 250 up to 300 ppm. In other embodiments, the amount of ion is 75, 150, or 300 ppm.

The alkaline earth metal ion can be provided by any salt that will dissociate the ion. Examples of the salts are halide salts, such as chloride, sulfate salts, citrate salts, acetate salts, formate salts, and nitrate salts. Also, hydroxides can be used if the pH is balanced with an acid source. In some embodiments, the salt can be at least one salt chosen from magnesium chloride, magnesium chloride hexahydrate, calcium chloride, and magnesium sulfate.

Without wishing to be limited to theory, it is theorized that anionic agents interact with divalent salts and act as a linking agent between salt and MFC fibers, which are nonionic but are thought to inherit a slight negative charge upon wetting by predominantly anionic surfactants. This then produces increased yield stress (structuring). This increased yield stress can effectively stabilize suspended materials in the composition including those that are non-density matched to the composition.

The resulting composition can provide a yield stress that is at least 0.7 Pa. The yield stress is measured using the method described below. In other embodiments, the yield stress is 0.7 to 1 Pa.

Suspended materials are defined as water insoluble visible particles. They can be functional or non-functional (aesthetic), i.e. functional materials have components that augment the performance capabilities of the product and non-functional materials are present solely for aesthetic purposes. Functionality can often be provided by encapsulating materials that deliver functional benefits or by providing a tactile benefit (e.g. scrubbing). Functional materials, however, may also have aesthetic purposes.

The suspended material can be density matched or non-density matched to the liquid portion. Density matched means that the density of the suspended material is close to the density of the liquid portion so that the suspended material remains suspended. A key benefit of the Cellulon™/Axcel™ material is that it provides a yield stress to suspend particles of varying density range but does not add to the perceived viscosity of the product compared to traditional, unstructured compositions. In one embodiment, the density of the suspended material has a density that is 97% to 103% of the density value of the liquid portion.

In one embodiment, the composition can be designed to provide an aesthetic benefit with suspended material in a clear or colored liquid. For more information about different aesthetics that can be used, see United States Patent Publication No. 2007/0010415A1.

Suspended Materials

At least a portion of the suspended material is of any size that is viewable by a person. By viewable it is meant that the suspended material can be seen by a non-color blind person with an unaided eye at 20/20 or corrected to 20/20 with glasses or contact lenses at a distance of 30 cm from the composition under incandescent light, florescent light, or sunlight. In other embodiments, at least 50%, at least 60%, at least 70%, at least 80%, at least 90%, at least 95%, or at least 99% of the particles are viewable by a person. In one embodiment, the particle size is 100 to 2500 microns in a longest dimension of the suspended material. In another embodiment, the particle size is 250 to 2250 microns. In another embodiment, the particle size is 500 to 1500 microns. In another embodiment, the particle size is 700 to 1000 microns. In another embodiment, a combination of more than one particle sizes can be used.

The suspended material can have any shape. Examples of shapes include, but are not limited to, spherical, polyhedral, cubic, box, tetrahedral, irregular three dimensional shapes, flat polygons, triangles, rectangles, squares, pentagons, hexagons, octagons, stars, characters, animals, plants, objects, cars, any other desired shape, or combinations thereof.

The suspended material can be present in any amount in the composition that allows the suspended material to remain suspended. In one embodiment, the suspended material is present in an amount of 0.01 and 10% by weight of the total composition.

The suspended material can be selected to be of one size and one shape, one size and a combination of shapes, a combination of sizes and one shape, or a combination of sizes and a combination of shapes. Also, the color of the suspended material can be varied along with the size and/or shape. Mixtures of suspended materials that vary by size, shape, and/or color can be used to communicate different attributes that the product can deliver to a consumer.

The suspended material can be functional, non-functional (aesthetic), or a combination of both. They can be made from a variety of materials such as the following non-limiting examples: gelatin, cellulose, agar, waxes, polyethylene, and insoluble inorganic materials like silica and calcium carbonate. The material may also have an encapsulate core containing hydrophobic compounds and mixtures such as these non-limiting examples: aloe, vitamins, essential oils, natural oils, solvents, esters, or any fragrance ingredient. These materials may be density matched by encapsulating oils or other materials that help make the density of the suspended material equal to that of the bulk composition. Alternatively, they may be made porous in a way that allows the liquid portion to diffuse into the suspended material in a manner that is self density matching. Density matching produces compositions that can suspend material at a viscosity less than 1500 mPas. Also, the particles may be non-density matched, that is being either less or more dense than the composition. In these compositions, the liquid portion can be designed to have a yield stress to aid in the stabilization of suspended material.

Suspending Agents

Suspending agents are any material that increases the ability of the composition to suspend material. Examples of optional suspending agents include, but are not limited to, gellan gum, polymeric gums, polysaccharides, pectine, alginate, arabinogalactan, carageenan, xanthan gum, guar gum, rhamsan gum, furcellaran gum, and other natural gum. A synthetic suspending agent in one embodiment is a polyacrylate. One acrylate aqueous solution used to form a stable suspension of the solid particles is manufactured by Noveon as CARBOPOL™ Aqua 30. The CARBOPOL™ resins, also known as CARBOMER™, are hydrophilic high molecular weight, crosslinked acrylic acid polymers having an average equivalent weight of 76, and the general structure illustrated by the following formula has a molecular weight of 1,250,000; CARBOPOL™ 940 with a molecular weight of approximately 4,000,000 and CARBOPOL™ 934 with a molecular weight of approximately 3,000,000. The CARBOPOL™ resins can be crosslinked with polyalkenyl polyether, e.g. 1% of a polyalkyl ether of sucrose having an average of 5,8 alkyl groups for each molecule of sucrose.

The suspending agents can be used alone or in combination. The amount of suspending agent can be any amount that provides for a desired level of suspending ability. In one embodiment, the suspending agent is present in an amount from 0.01 to 10% by weight of the composition.

Liquid Portion

The composition contains at least one surfactant. In certain embodiments, the surfactant is present in an amount that is at least 1% by weight of the composition based on the active amount of the surfactant. In other embodiments, the amount of surfactant is at least 5, 10, 20, 25, 30, 35, or 40% by weight. In another embodiment, the amount of surfactant is 1% to 45% by weight. The surfactant can be any surfactant or any combination of surfactants. Examples of surfactants include anionic, nonionic, cationic, amphoteric, or zwitterionic. For a list of surfactants and other materials that can be included in the composition, see United States Patent Publication No. 2007/0010415A1.

Water is included in the composition. The amount of water is variable depending on the amounts of other materials added to the composition.

The composition can be formulated to be any type of liquid cleaning composition. The composition can be used as a light duty liquid (LDL) dish detergent, hand soap, body wash, or a laundry detergent. One embodiment is for a LDL dish detergent.

In another embodiment, the composition can be degassed after the suspending agent is mixed with the surfactant and before suspended material is added. For further information, see U.S. Application No. 61/257,885 filed on 4 Nov. 2009 entitled "PROCESS TO PRODUCE STABLE SUSPENDING SYSTEM", which is incorporated herein by reference in its entirety. In another embodiment, the microfibrous cellulose is processed to obtain a particle size distribution that increases the suspending ability. For further information, see U.S. Application No. 61/257,872 filed on 4 Nov. 2009 entitled "MICROFIBROUS CELLULOSE HAVING A PARTICLE SIZE DISTRIBUTION FOR STRUCTURED SURFACTANT COMPOSITIONS", which is incorporated herein by reference in its entirety.

The compositions can be made by simple mixing methods from readily available components which, on storage, do not adversely affect the entire composition. Mixing can be done by any mixer that forms the composition. Examples of mixers include, but are not limited to, static mixers and in-line mixers.

Viscosity

The composition has a viscosity that allows the composition to be pourable. In certain embodiments, the viscosity is below 10,000 mPas. Viscosity is measured using a Brookfield RVT Viscometer using spindle 21 at 20 RPM at 25° C. In one embodiment, the viscosity is less than 5,000 mPas. In other embodiments, the viscosity is less than 1,500 mPas, less than 1,000 mPas, less than 750 mPas, or less than 500 mPas.

The yield stress is measured on a TA Instruments ARG2 controlled stress rheometer utilizing a small vane (15 mm diameter) geometry and 30 mm jacketed sample cup at 25° C. with a 10,000 μm gap. A conditioning step is programmed into the creep test—after loading the sample, a two minute "relaxation" period is used in which the sample is equilibrated to 25° C. before measurements are started. The 25° C. temperature is maintained by the instrument throughout the test. Yield stress was determined utilizing a sequential creep test method. In this test, to ensure reproducibility, samples were equilibrated in a sequence of four identical stress/relaxation steps at the lowest initial stress of 0.01 Pa. Once the sample was equilibrated, a further series of stress/relaxation steps were conducted with gradually increasing applied stress until the resulting plot on creep compliance vs. time graph shows an upward curvature. At this time, the test was stopped and the stress at which the bend occurs is taken as the "yield stress". The yield stress is measured with any suspended material present. When suspended material is present, the gap is selected to provide sufficient clearance so as not to interfere with the suspended material. The 10,000 μm gap is sufficient for suspended material having a particle size up to 2,000 μm.

Stability of the Composition

When a structured surfactant composition has been degassed prior to the addition of suspended material, the effect is that the composition maintains a stable suspending system over time. This can be measured by the yield stress of the composition. Over time, the yield stress is maintained. In one embodiment, the yield stress does not decrease by more than 20% of its value over a 3 month period. In other embodiments, the period of time is at least 4, 5, 6, 7, 8, 9, 10, 12, or 18 months. In one embodiment, the drop in yield stress is less than 10% over any of the previously listed periods of time. The yield stress is measured at an initial time and then after the given period of time.

In one embodiment, the composition has a yield stress that is at least 0.3 Pa. In other embodiments, the yield stress is at least 0.5, 0.6, 0.7, 0.8, 0.9, or 1 Pa. For most suspended material, a yield stress of up to 1.5 Pa is sufficient. In other embodiments, the yield stress is 0.3 to 1.5 Pa. In other embodiments, the yield stress is 0.5 to 1.5 Pa.

SPECIFIC EMBODIMENTS OF THE INVENTION

The invention is further described in the following examples. The examples are merely illustrative and do not in any way limit the scope of the invention as described and claimed.

Unstructured Dish Liquid Base Formula A.

| Ingredient | Ingred. % AI | Formula % AI | Formula Weight % (As Is) |
|---|---|---|---|
| Mg linear alkyl benzene sulfonate (MgLAS) | 45 | 12.325 | 27.389 |
| Na linear alkyl benzene sulfonate (NaLAS) | 52.5 | 4.223 | 8.044 |
| Lauryl Myristal Amidopropyl Amine Oxide | 33 | 7.436 | 22.533 |
| SD3A Alcohol | 92.8 | 1.210 | 1.304 |
| NH4 AEOS, 1.3 EO w/17% SD3A Alcohol | 58 | 15.706 | 27.079 |
| SXS Solution | 40 | 2.257 | 5.643 |
| Dissolvine DPTA Chelant | 40.5 | 0.147 | 0.363 |
| NaCl | 100 | 0.974 | 0.974 |
| Water, preservative, color, fragrance, pH adjustment with sulfuric acid | | q.s. to 100 | |

Target formula pH between 6.7 to 7.3

Using the common base formula A, the following formulas were prepared. In each formula, additional water was added until the amount of surfactants on an actives basis was 41 weight %. Magnesium chloride hexahydrate and Calcium chloride anhydrous salts were used for the below experiments.) In the examples, MFC/co-agents refers to the 6:3:1 microfibrous cellulose:xanthan gum:carboxymethyl cellulose, which is sold as Cellulon™ PX from CPKelco.

| Ingredient | B | C | D | E | F | G | H | I | J | K | L | M | N | O | P |
|---|---|---|---|---|---|---|---|---|---|---|---|---|---|---|---|
| Common Base Formula A | X | X | X | X | X | X | X | X | X | X | X | X | X | X | X |
| 0.008% CMC | | | X | X | | | | | | | | | | | |
| 0.024% Xanthan gum | | | | | X | X | | | | | | | | | |
| 0.08% 6:3:1 microfibrous cellulose:xanthan gum:carboxymethyl cellulose | | | | | | | X | X | X | X | X | X | X | X | X |

-continued

| Ingredient | B | C | D | E | F | G | H | I | J | K | L | M | N | O | P |
|---|---|---|---|---|---|---|---|---|---|---|---|---|---|---|---|
| 75 ppm Mg2+ | | | | | | | | X | | | | | | | |
| 150 ppm Mg2+ | | | | | | | | | X | | | | | | |
| 300 ppm Mg2+ | | X | | X | | X | | | | X | | | | | |
| 600 ppm Mg2+ | | | | | | | | | | | X | | | | |
| 75 ppm Ca2+ | | | | | | | | | | | | X | | | |
| 150 ppm Ca2+ | | | | | | | | | | | | | X | | |
| 300 ppm Ca2+ | | | | | | | | | | | | | | X | |
| 600 ppm Ca2+ | | | | | | | | | | | | | | | X |
| Softened Water | q.s. | q.s. | q.s. | q.s. | q.s. | q.s. | q.s. | q.s. | q.s. | q.s. | q.s. | q.s. | q.s. | q.s. | q.s. |
| Yield Stress (Pa) | 0 | 0 | 0 | 0 | 0 | 0 | 0.74 | 0.88 | 0.96 | 0.95 | 0.91 | 0.79 | 0.87 | 0.92 | 0.79 |
| Viscosity (mPas) | 920 | 752 | 902 | 793 | 864 | 779 | 774 | 847 | 838 | 884 | 870 | 863 | 856 | 875 | 842 |

It can be seen that carboxymethyl cellulose and xanthan gum in combination with magnesium ions did not create a yield stress. The yield stress was only created when microfibrous cellulose was included.

It can be seen that viscosity did not significantly increase with increasing yield stress.

Additional examples were prepared below with a different surfactant system. Formula Q in the table below has a slightly reduced anionic to nonionic surfactant mixture and reduced total active surfactant as compared to Formula A. Formula Q does not contain MgLAS or NaLAS surfactants.

| Ingredient | Ingred. % AI | Formula % AI | Formula % (As Is) |
|---|---|---|---|
| NH4 AEOS, 1.3 EO w/17% SD3A Alcohol | 58.0 | 24.530 | 37.586 |
| Lauryl Myristal Amidopropyl Amine Oxide | 33.0 | 6.21 | 16.727 |
| Sodium Bisulfite | 38.0 | 0.101 | 0.265 |
| MgSO4 Solution | 25.0 | 0.502 | 2.009 |
| Pluronic L44 | 100.0 | 0.400 | 0.400 |
| SD3A Alcohol | 92.8 | 1.010 | 1.089 |
| Dissolvine DPTA Chelant | 40.5 | 0.125 | 0.309 |
| NaCl | 100.0 | 2.000 | 2.000 |
| Water, preservative, color, fragrance, pH adjustment with sulfuric acid | | q.s. to 100 | |

Targete formula pH between 6.7 to 7.3

Formula Q contains $MgSO_4$. Using the common base formula Q, the following formulas were prepared. In each formula, additional water was added until the amount of surfactants on an actives basis was 37.4 weight %. In the table below, the amount of magnesium ion is in addition to the amount from the $MgSO_4$. The $MgSO_4$ contributes 10 ppm $Mg^{2+}$ ion to the composition.

| Ingredient | R | S | T | U | V | W | X | Y | Z | ZA | ZB | ZC | ZD | ZE | ZF |
|---|---|---|---|---|---|---|---|---|---|---|---|---|---|---|---|
| Common Base Formula Q | X | X | X | X | X | X | X | X | X | X | X | X | X | X | X |
| 0.008% CMC | | | X | X | | | | | | | | | | | |
| 0.024% Xanthan gum | | | | | X | X | | | | | | | | | |
| 0.08% 6:3:1 microfibrous cellulose:xanthan gum:carboxy-methyl cellulose | | | | | | | X | X | X | X | X | X | X | X | X |
| 75 ppm Mg2+ | | | | | | | | X | | | | | | | |
| 150 ppm Mg2+ | | | | | | | | | X | | | | | | |
| 300 ppm Mg2+ | | X | | X | | X | | | | X | | | | | |
| 600 ppm Mg2+ | | | | | | | | | | | X | | | | |
| 75 ppm Ca2+ | | | | | | | | | | | | X | | | |
| 150 ppm Ca2+ | | | | | | | | | | | | | X | | |
| 300 ppm Ca2+ | | | | | | | | | | | | | | X | |
| 600 ppm Ca2+ | | | | | | | | | | | | | | | X |
| Softened Water | q.s. | q.s. | q.s. | q.s. | q.s. | q.s. | q.s. | q.s. | q.s. | q.s. | q.s. | q.s. | q.s. | q.s. | q.s. |
| Yield Stress (Pa) | 0 | 0 | 0 | 0 | 0 | 0 | 0.87 | 0.94 | 0.95 | 0.97 | 0.96 | 0.95 | 0.97 | 0.94 | 0.85 |
| Viscosity (Cps) | 862 | 884 | 897 | 923 | 980 | 962 | 1,104 | 995 | 957 | 924 | 877 | 939 | 899 | 883 | 819 |

Again, it can be seen that carboxymethyl cellulose and xanthan gum in combination with magnesium ions did not create a yield stress. The yield stress was only created when microfibrous cellulose was included. It can be seen that viscosity did not significantly increase with increasing yield stress.

The above examples show that the yield stress of a system with microfibrous cellulose can be increased with the inclusion of an alkali metal ion, which will result in support of suspended material.

What is claimed is:

1. An aqueous composition comprising a) at least one surfactant;

b) a suspending agent comprising microfibrous cellulose;

c) 10 to 600 ppm of a calcium ion; and d) water, wherein the composition has a yield stress of at least 0.7 Pa.

2. The composition of claim 1, wherein the amount of calcium ion is 75 to 300 ppm.

3. The composition of claim 1, wherein the suspending agent further comprises xanthan gum and carboxymethyl cellulose.

4. The composition of claim 1, wherein the suspending agent comprises a 6:3:1 blend by weight of microfibrous cellulose:xanthan gum:carboxymethyl cellulose.

5. The composition of claim 1 further comprising suspended material.

6. The composition of claim 5, wherein the suspended material is non-density matched suspended material.

7. The composition of claim 1, wherein the calcium ion is provided by at least one salt chosen from halide salts, sulfate salts, citrate salts, acetate salts, formate salts, or nitrate salts.

* * * * *